United States Patent [19]

Wohlfarth et al.

[11] Patent Number: 5,015,989

[45] Date of Patent: May 14, 1991

[54] FILM RESISTOR WITH ENHANCED TRIMMING CHARACTERISTICS

[75] Inventors: Paul D. Wohlfarth, Vernonia; Gregg L. Buchanan, Forest Grove, both of Oreg.

[73] Assignees: Pacific Hybrid Microelectronics, Inc.; N.W. Silicon Specialists, Inc., both of Portland, Oreg.

[21] Appl. No.: 387,085

[22] Filed: Jul. 28, 1989

[51] Int. Cl.[5] ..... H01C 10/00

[52] U.S. Cl. ..... 338/195; 338/49; 219/121.69

[58] Field of Search ..... 219/121.68, 121.69; 338/49, 195

[56] References Cited

U.S. PATENT DOCUMENTS 3,889,223 6/1975 Sella et al. ..... 338/195
4,041,440 8/1977 Davis et al. ..... 338/195
4,551,607 11/1985 Moy ..... 219/121.69

*Primary Examiner*—C. L. Albritton
*Attorney, Agent, or Firm*—Chernoff, Vilhauer, McClung & Stenzel

[57] ABSTRACT

A film resistor for use in electrical circuits, the resistor including a shunt conductor electrically connected in parallel with a portion of the resistive film, at a location spaced apart from the principal circuit conductor terminals of the resistor. The resistor is made with an intentionally low initial resistance, and is trimmed to a predetermined resistance by removal of a portion of the resistive material between the circuit conductor terminals. A plunge cut made in the resistive material by a trimmer and extending toward the shunt conductor can be used to provide a wide range of change of resistance without excessive increase of the rate of change of resistance as a function of extension of the plunge cut.

20 Claims, 4 Drawing Sheets

FILM RESISTOR WITH ENHANCED TRIMMING CHARACTERISTICS

BACKGROUND OF THE INVENTION

The present invention relates to thick film and thin film electrical resistors, and particularly to resistors of those types which can be trimmed to a required resistance with improved accuracy.

It is well known that the resistance of film resistors can be increased, from a low initial value provided intentionally, when a film of resistive material is deposited on a substrate, to a higher final value which is desired for the use of such a film resistor in a circuit, by removing a portion of the resistive material through the use of a laser trimmer. Because of the inaccuracies inherent in manufacturing printed film resistors, particularly thick film resistors often used in hybrid microelectronic circuits, individual resistors in an array printed as a unit may initially be as much as 50% low in resistance, in order to ensure that none of the resistors manufactured in the array has too high a resistance to be useable. After such resistors are printed onto a substrate as a group they are trimmed individually to increase the resistance of each resistor to the required value. Trimming is accomplished, typically, by the use of a controlled stream of mechanically abrasive particles, or a laser beam, under automatic computer control to cut away a narrow strip of resistive material. This has the effect of narrowing or elongating the path for current through the resistor, or both narrowing and elongating the path. It is desirable for the sake of economy to provide a film resistor which can be trimmed to the required value in a minimum amount of time and with a minimum amount of trimming. Of course, the value of the trimmed resistor must be accurate within the required tolerances.

There are several problems involved with trimming of resistors as conventionally accomplished using automatic trimmers. In using a simple plunge cut to trim previously available film resistors, the rate of change of resistance for a given additional extension of a trimming cut increases rapidly, particularly as the plunge cut approaches an opposite margin of a film resistor. Thus, for a physically small resistor which initially had a significantly low resistance requiring a long trim cut, the value of the trimmed resistor may differ from the desired final resistance by a wider margin than is desirable. That is, since an abrasive stream or a laser beam is finite in size the smallest amount of change of resistance which can be accomplished under computer control using a simple plunge cut in a conventional film resistor may exceed the allowable range of values of the resistor when the plunge cut approaches the opposite margin of the resistive film of the resistor, when the initial resistance was quite low. It has been a rule of thumb, therefore, that a plunge cut should not be used to increase a resistor's initial value more than 100%.

Another problem with previously available film resistors is that significant amounts of trimming may reduce the power capacity of a film resistor below the minimum required, which is to say that the current density may be too high at some points in the portions of the film of resistive material remaining after trimming. Additionally, a long plunge cut may even reach an opposite edge of a film of resistive material, severing the resistor and rendering worthless the entire printed circuit of which the resistor is a part. Limiting the length of a plunge cut in order to limit current density may require a second trim cut (a "shadow cut") alongside the plunge cut to provide the remaining amount of trimming of the resistor without reducing current capacity unacceptably. Making such a shadow cut increases the amount of time required to trim a resistor, resulting in higher manufacturing costs for the circuit.

Preferably, a resistor should be able to be trimmed by a single rectilinear, or plunge, cut which can be accomplished quickly and accurately using a computer controlled trimmer. In the past, however, automatic control of a trimmer has required that the speed of advance of an abrasive or laser trimming beam be reduced, in order to provide the required accuracy in the final resistance value. This reduction of trimming speed also increases the required time and thus the expense of resistor trimming.

Other patterns for cutting the resistive film of such a resistor to trim the resistance are more complex to control by computers and take more time than a plunge cut to provide the required trimming of the resistor.

What is needed, then, is a film resistor which can be manufactured economically using known technology, and a method for trimming such a resistor accurately and quickly over a wider range of resistance values than has previously been possible, to provide a final value of resistance which is dependably accurate within required tolerances upon completion of trimming. Preferably, such a resistor and method should also eliminate resistor destruction resulting from the trimming process.

SUMMARY OF THE INVENTION

The present invention overcomes the aforementioned shortcomings of conventional film-type electrical resistors and provides an improved film resistor for inclusion in a printed circuit or integrated circuit, and a method for trimming such a resistor accurately over a wide range of values for each resistor. In a film resistor in accordance with the present invention a shunt conductor is connected electrically to conduct current around a portion of the film of resistive material which is spaced apart from either of a pair of primary conductor terminals used to interconnect the resistor with a circuit of which it is a component. In one embodiment of the invention the shunt conductor is connected to a primary conductor lead electrically connected to one of the primary conductor terminals.

In another preferred embodiment of the invention, the shunt conductor is connected around a portion of the resistor, essentially in parallel with a portion of the resistor spaced apart from the primary conductor terminal connection pads. Preferably, the shunt conductor is in the shape of a "C," so that a middle portion of the shunt is spaced apart from the edge of the film of resistive material forming the basic resistor. A trim cut or slit, preferably a plunge cut made from one margin of the film of resistive material in a straight line toward the shunt, can cut completely through the resistor's film of resistive material between the junctions of the arms of the C-shaped shunt conductor with the resistive film without disconnecting the resistor's conductor terminal pads from one another, since a path for current is provided through the shunt conductor from one of the remaining portions of the film of resistive material to the other. In a resistor thus made in accordance with the invention, extension of the plunge trim cut increases the length of the shortest path for electricity through the resistor, yet does so without reducing the load-carrying capacity of the resistor unacceptably, as the current is simply diverted to proceed through the shunt to an increasing degree as the plunge cut used to trim the resistor is extended toward the shunt, narrowing the most restricted portion of the resistive film.

In a resistor provided with a C-shaped shunt in accordance with the present invention, the rate of change of resistance as a function of the extension of a plunge cut remains constant over a significant portion of the potential length of a plunge cut. The rate of increase of resistance as a function of increased length of the cut may even decrease as a plunge cut extends through the final portion of the film of resistive material remaining before the cut divides the area of the film of resistive material into two pieces. Further trimming of the resistor can still be accomplished, if necessary, after the film of resistive material has been divided, and continuity through the resistor is preserved by the shunt, while the resistance can be increased using a simple plunge cut by a greater amount, relative to the initial resistance, than was previously possible within acceptable tolerances.

It is a principal object of the present invention, therefore, to provide a printed film resistor, which can be trimmed reliably to a desired value with improved accuracy.

It is another object of the present invention to provide a film resistor which can be trimmed efficiently over a wide range of change of resistance to achieve a desired value within a desired tolerance without unacceptably limiting the power capacity of the resistor.

It is another object of the invention to provide a film resistor which can be trimmed to a desired value within a wide range of values without increasing the current density in any of the resistive material beyond an acceptable value.

It is a further object of the present invention to provide an improved method for manufacturing and trimming a film resistor to a desired value.

It is a principal feature of a resistor according to the present invention that it includes a parallel shunt conductor to carry a portion of the resistor current.

It is an important advantage of a resistor according to the present invention that its path of conductivity is not opened even if a laser trim cut divides the area of resistive film material into two parts.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
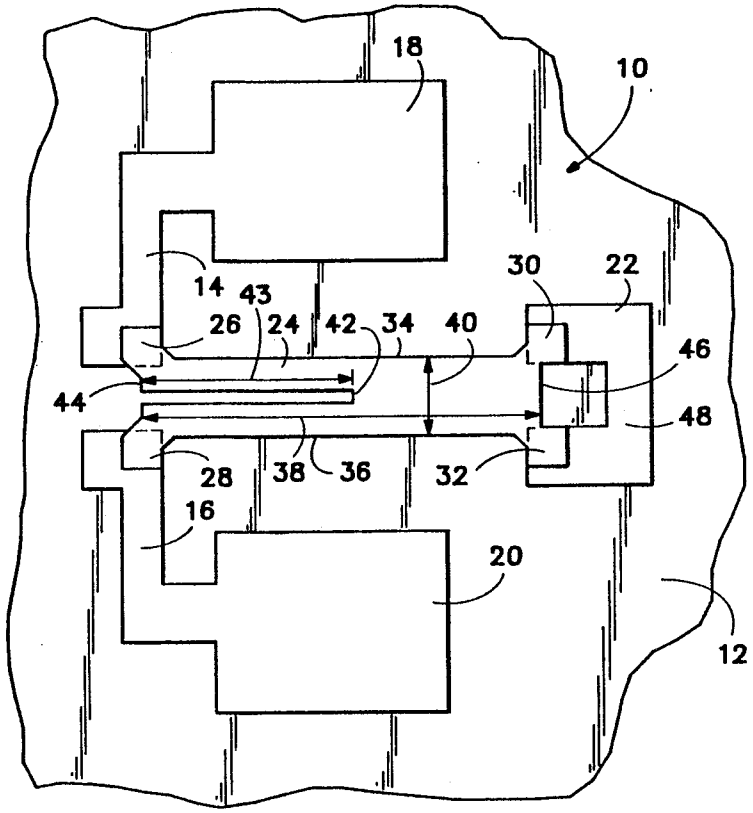
FIG. 1 is a plan view of a thick film "top hat" resistor including a shunt embodying the present invention.

Referring now to the drawings which form a part of disclosure, in FIG. 1, a printed film resistor 10 is located on a dielectric substrate 12 which may be of a conventional ceramic or polymeric resin material, for example. Conventional conductor leads 14 and 16 are of a suitable low-resistance printed film material applied in a conventional manner to the substrate 12 which would ordinarily extend beyond the portion shown herein to support other portions of an electronic circuit. Terminal connection pads 18 and 20, to which the conductor leads 14 and 16 are respectively interconnected may be of the same or similar material, to provide for interconnection of the resistor 10 with other elements of a circuit mounted on the substrate 12. A shunt conductor 22 may also be of the same or similar conductive material of low resistivity used for the leads 14 and 16, and has generally the form of a "C", although facing backwards as shown in FIG. 1. All of the conductor leads 14 and 16, terminal pads 18 and 20, and the shunt conductor 22 may be applied to the substrate 12 as heat fusible inks by conventional screen printing processes and thereafter cured.

Subsequently, a resistive film 24 is applied by conventional screen processes, for example, in a position of registration which provides overlapping electrical interconnection areas 26 and 28 where the resistive film interconnects with the conductor leads 14 and 16, respectively. Additional overlapping interconnection areas 30 and 32 provide for connection with the two arms of the shunt conductor 22. The overall general shape of the area of the deposited resistive film 24 is elongate, including a pair of opposite lateral edges 34 and 36. The film 24 of resistive material is heat cured in the normal manner, to provide interconnection in each of the overlapping interconnection areas 26, 28, 30, and 32. Normally, the deposited resistive film 24 will have a substantially uniform thickness, so that the resistance is related directly to the path length and inversely to the path width of the resistive film material.

The length 38 of the area of resistive film 24, between the overlapping interconnection areas 26 and 28 for the conductor leads 14 and 16 at one end of the area of resistive film and the interconnection areas 30 and 32, interconnecting the resistive film 24 with the shunt conductor 22 at the other end of the area of resistive film 24, is significantly greater than the width 40 of the film 24 of resistive material between the lateral edges 34 and 36. For example, the length 38 may be at least four times the width 40, so that the resistor 10, except for the presence of the shunt conductor 22 and its overlapping interconnections 30 and 32, has the configuration of a conventional top hat resistor.

In accordance with the present invention the resistor 10 may be trimmed effectively using an automatic resistor trimmer producing a trimming cut, for example, a narrow slit such as the plunge cut 42, having a length 43. The trimming cut is made by a controlled stream of abrasive particles, or by a laser beam, and removes a portion of the film of resistive material 24, removing the entire thickness of the film in that portion, commencing at the terminal end margin 44 of the film 24. While a wider trimming cut could also be used, a narrow plunge cut is effective and more quickly made. Creation of the plunge cut 42 produces an increase in the effective resistance of the resistor 10 as measurable between the terminal pads 18 and 20, as the available width of resistive film material is reduced, and the shortest path of conductivity for electrical current is lengthened, between the interconnection areas 26 and 28.

As the plunge cut 42 is extended away from the terminal end margin 44 toward the shunt conductor end margin 46 of the resistive film 24, the effective resistance of the resistor 10 is gradually increased as a result, and an increasing portion of the resistor current is carried through the shunt conductor 22.

Depending upon the conductivity of the material of the shunt conductor, and depending similarly on the total resistance of the shunt conductor 22, which normally will be lower than the resistance of the resistive film 24 by at least an order of magnitude, the rate of increase of resistance seen between the terminal pads 18 and 20 as a function of extension of the plunge cut 42 will actually decrease as the portion of the total resistor current which is carried by the shunt conductor 22 increases.

It will be noted that the "C" shape of the shunt conductor 22 includes a central body 48 and a pair of arms which extend generally laterally from the central body 48, providing an open space between the shunt conductor end margin 46 and the central body 48 of the shunt conductor 22. As a result, should the plunge cut 42 be extended the entire distance to the shunt conductor end margin 46 of the resistive film 24, the entire resistor current can be carried through the shunt conductor 22, entering one arm of the shunt conductor 22 through the overlapping interconnecting area 30, passing through the central body 48, and being carried thence through the other arm of the shunt conductor and the overlapping interconnection area 32 to the other one of the separated portions of what originally was a single area 24 of resistive film material.

Figure 2:
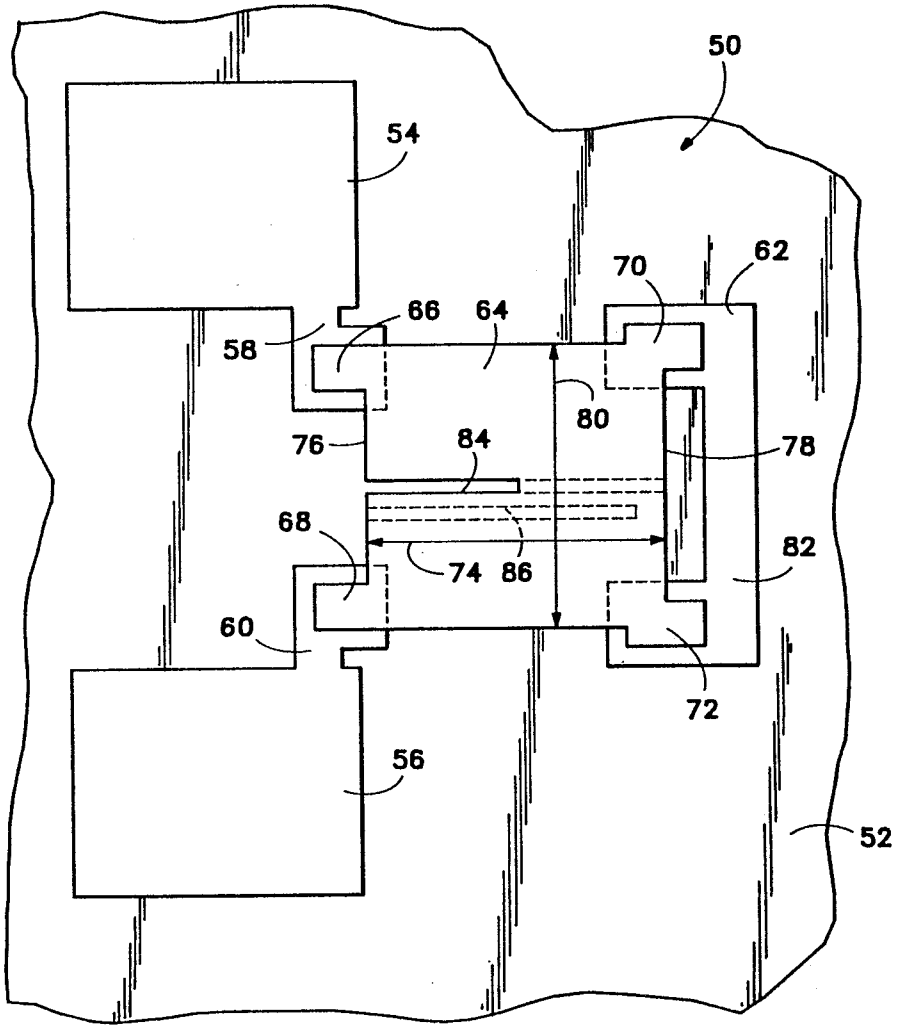
FIG. 2 is a plan view of a thick film "square" resistor including a shunt embodying the present invention.

Referring now to FIG. 2, a resistor 50 is similar to the resistor 10, except that its general shape is closer to the shape of a conventional square thick film resistor. The resistor 50 is located on a substrate 52 and includes terminal pads 54 and 56, conductor leads 58 and 60, and a C-shaped shunt conductor 62. A generally nearly square film 64 of resistive material is connected at overlapping interconnection areas 66 and 68 to the conductor leads 58 and 60, respectively, and is connected to the arms of the shunt conductor 62 at interconnection areas 70 and 72, respectively. The resistive film 64 has a length 74, between a terminal end margin 76 and a shunt conductor end margin 78, and has a width 80. A central body 82 of the shunt conductor 62 is spaced apart from the shunt conductor end margin 78 of the film of resistive material 64. A plunge cut 84, extending a distance as required to achieve the intended resistance, is used in accordance with the present invention, extending from the terminal end margin 76 of the resistor 50 lengthwise of the film 64 of resistive material, toward the shunt conductor end margin 78. As with the resistor 10, should the plunge cut 84 extend entirely to the shunt conductor end margin 78, the shunt conductor 62 carries the entire resistor current. Should the desired resistance not be achieved by extending the plunge cut 84 the entire distance from the terminal end margin 76 to the shunt conductor end margin 78, an additional cut, called a shadow cut 86, whose position is indicated in broken line in FIG. 2, may be made alongside and parallel with the plunge cut 84 to increase the resistance of the resistor 50 further, yet without too great an increase in the current density in any part of the resistive film 64.

Figure 3:
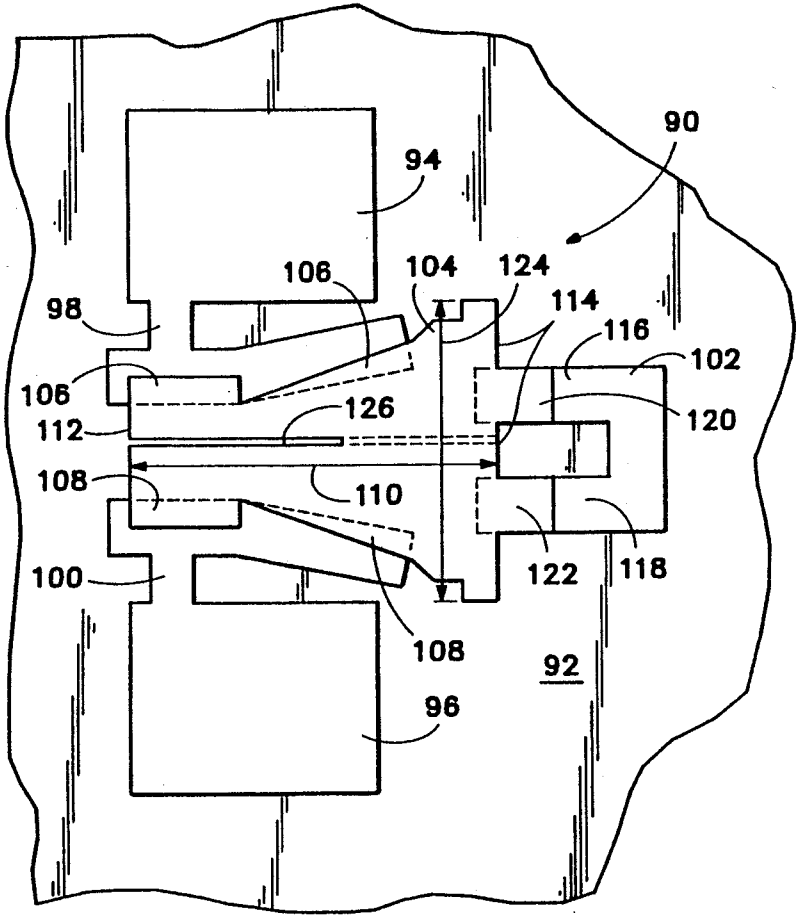
FIG. 3 is a plan view of a thick film "teardrop" resistor including a shunt embodying the present invention.

In FIG. 3, a roughly teardrop-shaped resistor 90 is shown on a substrate 92. Terminal pads 94 and 96, conductor leads 98 and 100, and a C-shaped shunt conductor 102, all of material of relatively high conductivity, are printed in film form on the substrate 92 by conventional means. A generally teardrop-shaped film 104 of resistive material is then deposited in proper registration and is cured by conventional methods. The conductor leads 98 and 100 extend a short distance parallel with one another and then include portions which diverge away from one another. Opposite side marginal portions of the film 104 partly overlap the parallel and diverging portions of the conductor leads 98 and 100, defining conductor lead overlapping interconnection areas 106 and 108, which extend along a majority of the length 110 of the teardrop-shaped area of resistive film 104, between its terminal end margin 112 and its shunt conductor end margin 114. Respective overlapping shunt conductor interconnection areas 120 and 122 extend as projections beyond the general line of the shunt conductor end margin 114, overlapping respective arms 116 and 118 of the shunt conductor 102. The maximum width 124 of the film of resistive material 104 is found along the shunt conductor end margin 114, and the width of the film 104 decreases gradually with increased distance from the shunt conductor end margin 114, through a majority of the length 110 of the film 104. The teardrop-shaped resistor 90 is preferably laser trimmed by the use of a plunge cut 126 proceeding from the terminal end margin 112 of the film 104 toward the shunt conductor end-margin 114, in generally the same manner which was previously described in connection with the resistors 10 and 50 shown in FIGS. 1 and 2. Because of the location of the conductor lead overlapping interconnection areas 106 and 108, and because the width of the film 104 of resistive material increases with proximity to the shunt conductor end margin 114, the rate of increase of resistance as a function of increased length of the plunge cut 126 is relatively gradual by comparison with the effect of increased length of the plunge cut 42 in the top hat resistor 10.

Figure 4:
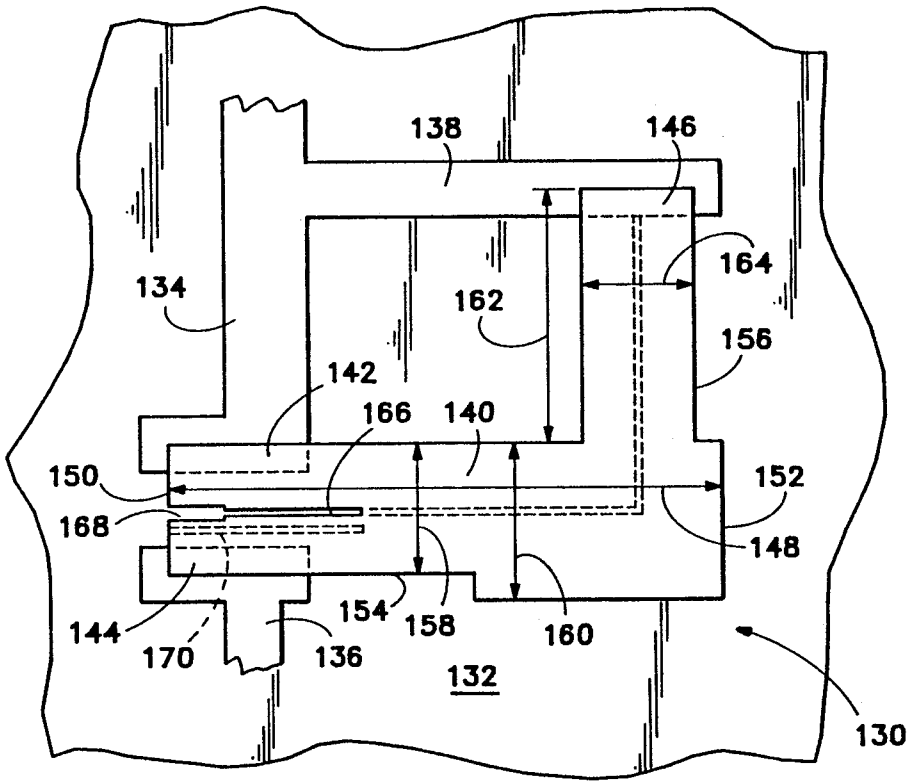
FIG. 4 is a plan view of a thick film L-shaped resistor including a shunt embodying the present invention.

Referring now to FIG. 4, an L-shaped film resistor 130, located on a substrate 132, is yet another embodiment of the present invention. The resistor 130 includes a first conductor lead 134 and a second conductor lead 136. A shunt conductor 138 extends away from the first conductor lead 134 as a branch of it. All of the first and second conductor leads and shunt conductor 138 may be of conventional conductive material applied by conventional methods to the substrate 132, as with the resistors 10, 50, and 90 described previously. A film 140 of resistive material is applied in overlapping registration with the first and second conductor leads 134 and 136 and the shunt conductor 138 after they have been deposited and cured on the substrate 132, providing overlapping conductor terminal areas of interconnection 142 and 144, respectively. Similarly, a portion of the film 140 of resistive material overlaps the shunt conductor 138 in a shunt conductor overlapping interconnection area 146.

The resistive film 140 has the general shape of a "L", with a main leg 154 and a branch leg 156 which extends perpendicularly away from the end of the main leg 156 which is spaced apart from the conductor lead overlapping interconnection areas 142 and 144. The main leg 154 of the film 140 of resistive material has a length 148, between a terminal end margin 150 and a main leg end margin 152. The main leg 154 has a width 158 adjacent the interconnection areas 142 and 144 and a greater width 160 adjacent the branch leg 156. The branch leg 156 has a length 162 and a width 164. An L-shaped trim cut 166 which is preferably made by a laser or abrasive trimmer under computer control extends initially from a notch 168 defined in the terminal end margin 150 and extends lengthwise and centrally of the main leg 154 toward the main leg margin 152, and then turns and extends centrally along the branch leg 156 toward the shunt conductor overlap interconnecting area 146, as indicated in broken line in FIG. 4. Thus, extension of the L-shaped trim cut 166 initially results in an increase in length of the shortest path of electrical current between the first conductor lead 134 and the second conductor lead 136. As the trim cut 166 is extended along the L-shaped path described, an increasing amount of the current is diverted to be carried by the branch leg 156 and the shunt conductor 138. Ultimately, as the trim cut 166 extends the entire distance to the shunt conductor overlapping interconnecting area 146, the entire resistor current is carried along the lower and right hand side portions of the film 140, as it is shown in FIG. 4 and nearly the entire current is carried by the shunt conductor 138, to the practical exclusion of the first conductor lead 134. A shadow trim cut 170 parallel with the initial portion of the trim cut 166, as shown in broken line in FIG. 4, may be provided to increase the resistance of the resistor 130 further, should that be necessary.

Figure 5:
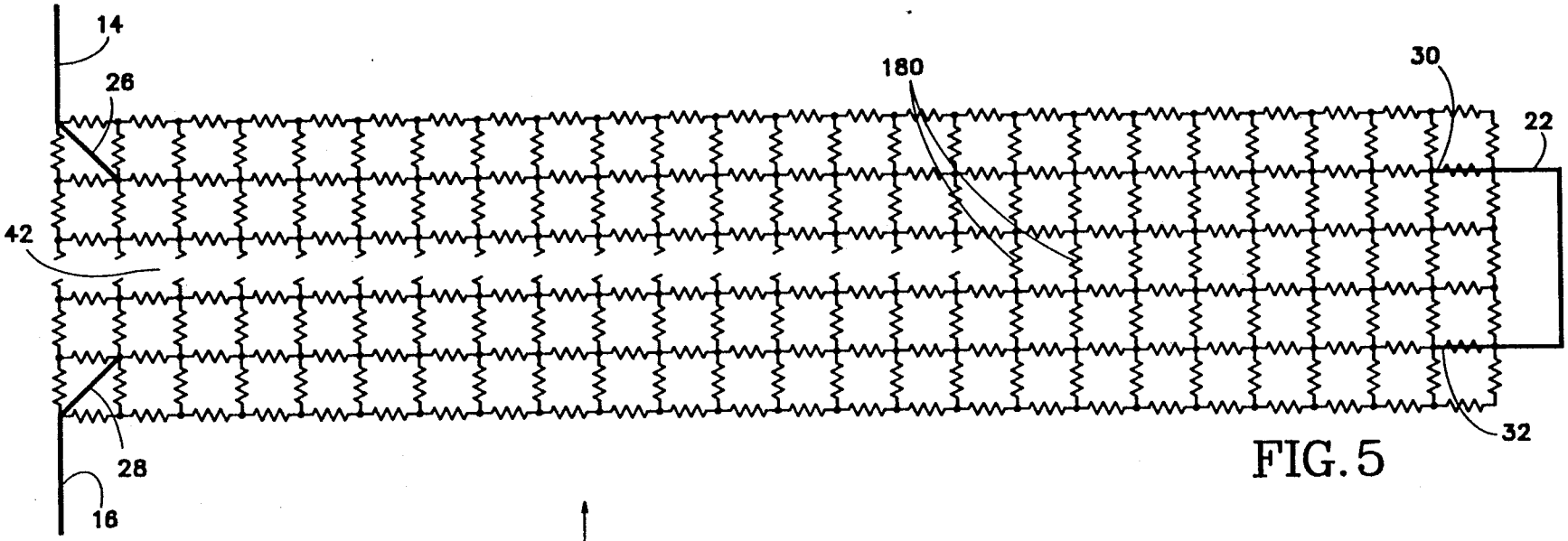
FIG. 5 is a schematic diagram useful as a model for showing the change in resistance to be expected as a result of trimming of a resistor such as the one shown in FIG. 2.
Figure 8:
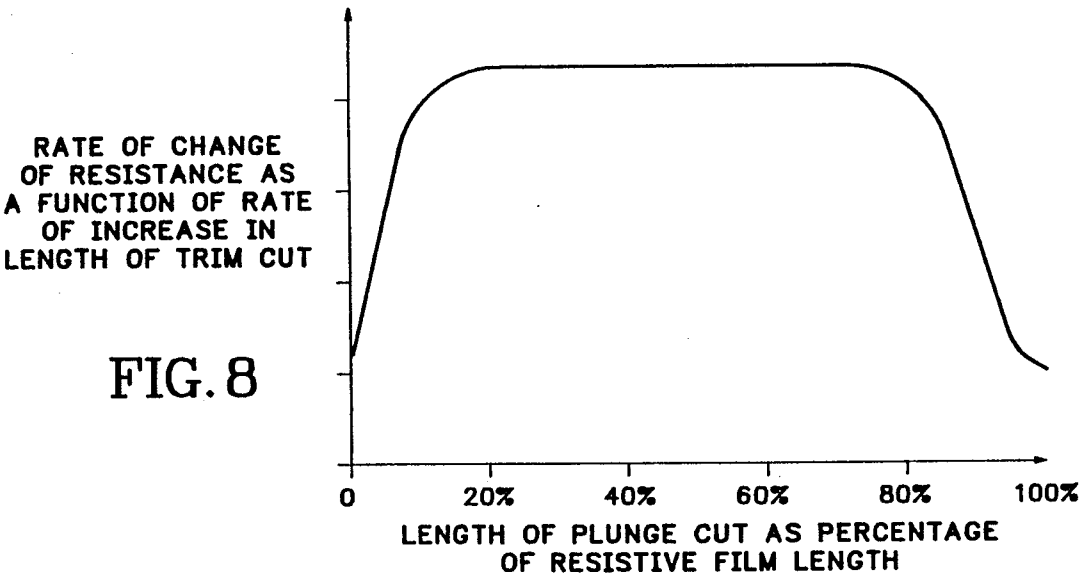
FIG. 8 is a graph showing the rate of change of resistance as a function of increased extent of a trim cut in the resistor shown in FIG. 6.
Figure 6:
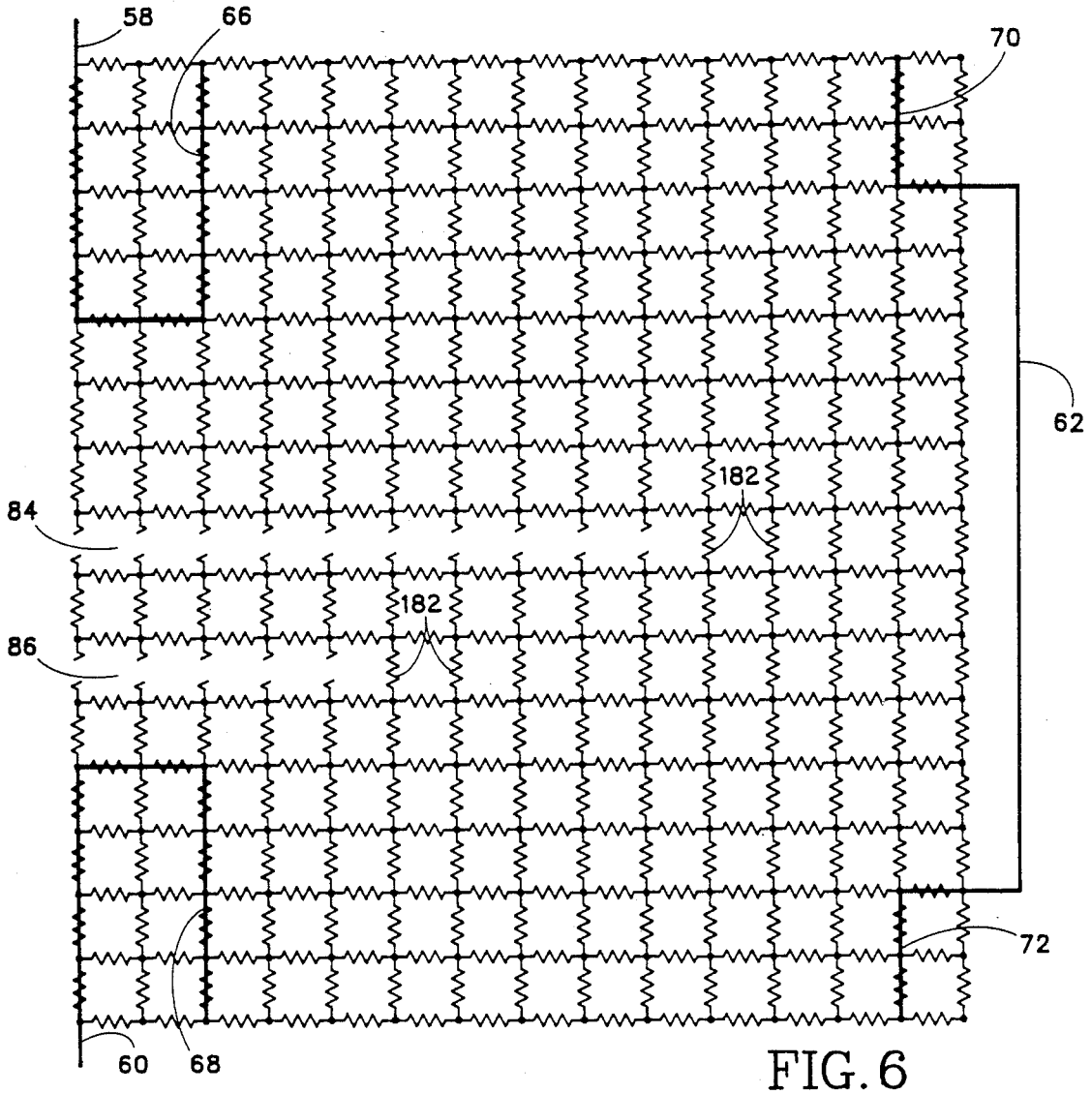
FIG. 6 is a schematic diagram useful as a model for showing the change in resistance to be expected as a result of trimming of a resistor such as the one shown in FIG. 1.
Figure 7:
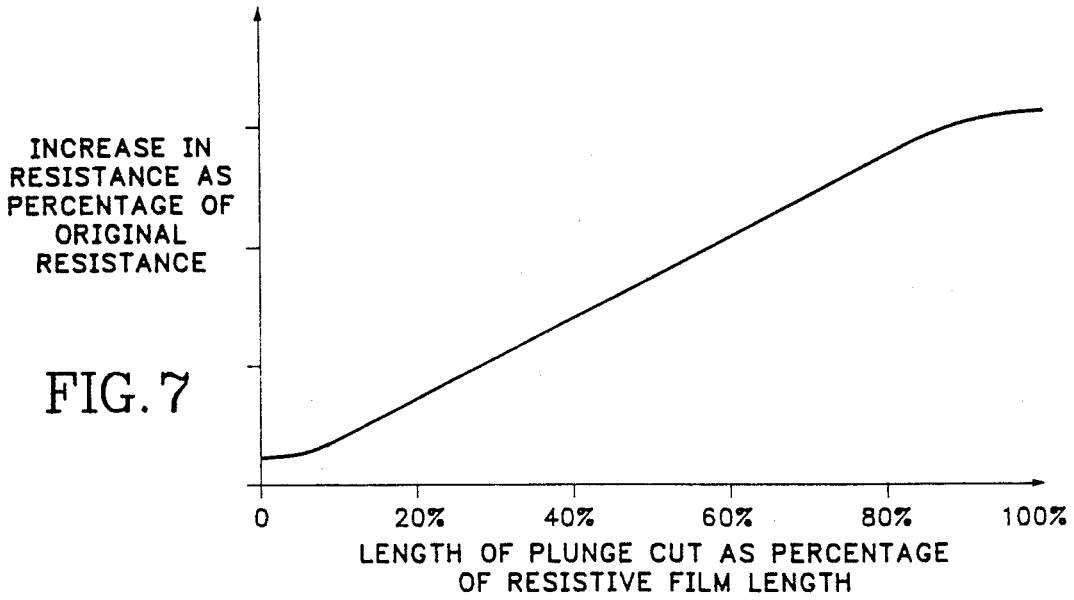
FIG. 7 is a graph showing the increase in resistance of the resistor shown in FIG. 1 as a function of the extent of a trim cut.

Referring now to FIGS. 5 and 6, the resistors 10 and 50 are shown, respectively, as schematic diagrams of resistive networks representative of the resistive film, terminal connections, and shunt conductors of the resistors 10 and 50 which can be used as models in computer program form to develop graphic predictions of the change in resistance which occurs as a result of progressive extension of the trim cuts 42 and 84. An incremental increase in the length of a trim cut 42 or 84 can be represented by opening an additional one of the resistance elements 180 or 182 shown, respectively, in FIGS. 5 and 6. A trim cut in such a film resistor initially increases the resistance at an increasing rate of change of resistance as a function of change of length of the trim cut, as shown in FIGS. 7 and 8. However, because of the shunt resistors included as parts of the resistors 10 and 50, over a majority of the length 38 of the resistor 10, the increase in resistance is nearly directly proportional to the increase in length of the trim cut. FIGS. 7 and 8 are representative of the change in resistance as a function of the length of a straight plunge cut and of the rate of change of resistance of the resistor 10 as a function of increasing plunge cut length. As the shunt conductor end margin 46 of the resistor 10 is approached by a laser trimming cut such as the plunge cut 42 the rate of increase of resistance, as a function of increased length of the plunge cut, actually decreases, rather than increasing steeply as is the case in conventional top hat shaped printed film resistors. As a result, an automatic laser trimmer can trim the resistor 10 quickly and accurately over an extended range of different resistances by comparison with a conventional top hat film resistor, since the rate of cutting need not be reduced during the further portions of a plunge trim cut to preserve the degree of accuracy of change or increase of resistance of the resistor. There is no rapid increase in resistance as a trim cut approaches the margin of the resistive material, because of the presence of the C-shaped shunt conductor 22 in the resistor 10. Furthermore, the current density in the resistive material of the remaining resistive film material 24 of the resistor 10 is not greatly increased and use of a plunge cut for trimming does not result in overloading of the resistor 10, even when the original resistance of the resistor 10 is much lower than the desired final resistance between the terminal pads 18 and 20. Similarly, trimming of the resistors 50, 90 and 130 over a wide range of change of resistance, from the initial value of the resistor 50, 90 or 130 as deposited to a desired final resistance, is accomplished gradually and without a drastic increase in rate of change of resistance as a function of rate of change of trim cut length.

Because the rate of change of resistance does not increase drastically throughout the length of a long plunge cut in the "top hat," "square", or "teardrop" shaped resistors 10, 50, and 90 according to the present invention, computer-controlled trimming of such resistors can be carried out quickly and with greater resultant accuracy than has been possible with conventional film resistors locking the shunt conductor provided by the present invention. The shunt conductor of the invention can be utilized with any printed resistor, either of the thick film or the photo-etched thin film type utilized in integrated electronic circuits. The resistors according to the present invention and the method of automatically controlled trimming according to the present invention also result in preservation of printed film resistors despite the intended or inadvertent extension of a laser trim cut nearly or completely to the opposite margin of the film of resistive material because of an initially lower-than-desired resistance of the printed film resistor being trimmed.

Although the foregoing detailed description has discussed resistors printed on a ceramic substrate as an example, it will be understood that resistors according to the invention could also be included in thin film form on silicon substrates as part of an integrated circuit.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A film resistor, comprising:

(a) a film of electrically resistive material having a predetermined shape;

(b) a pair of circuit conductor terminals connected to said film of resistive material at apart-spaced locations thereon; and (c) a shunt conductor of material having a lower resistivity than said resistive material, said shunt conductor being spaced apart from both of said circuit conductor terminals and not connected electrically with either of said circuit conductor terminals except through said film resistive material, and being interconnected with said film of resistive material at a shunt conductor terminal location on said film of resistive material spaced apart from said circuit conductor terminals, so as to be in position to carry a portion of an electric current flowing through said resistor between said conductor terminals.

2. The resistor of claim 1 wherein said shunt conductor extends along a marginal portion of said film of resistive material.

3. The resistor of claim 1 wherein said shunt conductor is connected electrically to said electrically resistive material of said film in at least two apart-spaced shunt conductor terminal locations thereon.

4. The resistor of claim 1 wherein said film of resistive material has a predetermined shape including a pair of opposite marginal portions, said shape defining a length and a width of said film, and said film having a substantially uniform thickness which is substantially less than either said length or said width.

5. The resistor of claim 1 wherein said shunt conductor includes first and second shunt terminal portions, said film having a pair of said shunt terminal locations spaced apart from each other, each of said shunt terminal portions being connected electrically to a respective one of said shunt terminal locations on said film of resistive material, and said shunt conductor including additionally an intermediate portion located spaced apart from said film of resistive material, defining a space between said shunt conductor and said film of resistive material.

6. The resistor of claim 1 wherein said shunt conductor includes a central body and a pair of terminal portions extending generally laterally from said central body toward said film of resistive material, said central body being spaced apart from said film of resistive material.

7. The resistor of claim 1 wherein said film of resistive material has a generally rectangular shape with said shunt conductor extending generally along a portion of one end thereof and said circuit conductor terminals being on the opposite end thereof.

8. The resistor of claim 1 wherein both of said circuit conductor terminals are located adjacent a margin of said film of resistive material and said film of resistive material defines a trim cut originating between said circuit conductor terminals and extending toward said shunt conductor.

9. The resistor of claim 8, further defining a shadow cut extending alongside a portion of said trim cut.

10. A film resistor, comprising:

(a) a film of resistive material having a predetermined shape;

(b) first and second apart-spaced circuit conductor terminals electrically connected with said film of resistive material;

(c) shunt conductor means, of material having a lower resistivity than said resistive material, and free of connection directly to said circuit conductor terminals, connected to said resistive material only at a location spaced apart from said circuit conductor terminals, for carrying a portion of an electric current between said first circuit terminal and said second circuit terminal; and (d) trim cut means defined by said film of resistive material for varying the path of said electric current through said resistive material so as to increase the resistance of said resistor, said trim cut means being located between said first circuit conductor terminal and said second circuit conductor terminal and having a length defined by said resistive material.

11. In a printed circuit, an electrical resistor, comprising:

(a) a dielectric substrate;

(b) a film of electrically resistive material adhered to an area of said substrate, said film having first and second marginal portions located opposite each other;

(c) means defining a pair of terminal pads of conductive material located on said first marginal portion and spaced apart from each other for connecting said resistor electrically into said printed circuit;

(d) shunt conductor means free of electrical connection to either of said terminal pads except through said film of resistive material, located adjacent and electrically interconnected with said second marginal portion of said film of resistive material and spaced apart from each of said terminal pads, for electrically interconnecting two respective apart-spaced areas of said second marginal portion.

12. The resistor of claim 11 wherein said shunt conductor means provides a path of least electrical resistance between said apart-spaced areas of said second marginal portion of said film of resistive material.

13. The resistor of claim 11 wherein said shunt conductor includes a central body and a pair of terminal portions extending from said central body toward said film of resistive material, said central body being spaced apart from said film of resistive material.

14. The resistor of claim 11 wherein said first and second marginal portions are located, respectively at opposite sides of said area of said substrate covered by said film of resistive material.

15. The film resistor of claim 10 wherein said trim cut means is located so that increased length of said trim cut means increases the proportion of said electric current which is carried through said shunt means.

16. The resistor of claim 11 wherein said film of resistive material has an elongate shape and said first and second marginal portions define opposite ends of said elongate shape.

17. A method for making a resistor having a predetermined resistance, comprising:

(a) providing a pair of circuit conductor terminal pads and a shunt conductor of electrically conductive material at predetermined apart-spaced and electrically unconnected locations on a substrate;

(b) electrically connecting a film of resistive material having a predetermined shape and generally uniform thickness to said conductor terminal pads and to said shunt conductor; and (c) trimming said resistor to a predetermined resistance value by cutting away a portion of said film of resistive material, thereby increasing the resistance of said resistor between said circuit conductor terminal pads, while maintaining electrical connection of said film of resistive material with said shunt conductor.

18. The method of claim 17 wherein said step of trimming includes elongating the shortest electrical path through said resistive material from one to the other of said pair of circuit conductor terminal pads.

19. The method of claim 17 wherein said step of cutting away a portion of said resistive material comprises cutting said resistive material along a line extending into said film of resistive material toward said shunt conductor from a location on a margin of said film of resistive material between said circuit conductor terminal pads.

20. The method of claim 19 including the further step of further increasing the resistance of said resistor after cutting away said resistive material along said line, by removing an additional narrow portion of said resistive material from the portion of said film remaining on one side of said line.

* * * * *